US011719057B1

(12) United States Patent
Parker

(10) Patent No.: US 11,719,057 B1
(45) Date of Patent: Aug. 8, 2023

(54) METHOD AND SYSTEM FOR MAINTAINING CONSTANT BACK PRESSURE DURING MANAGED PRESSURE DRILLING

(71) Applicant: PRUITT TOOL & SUPPLY CO., Fort Smith, AR (US)

(72) Inventor: Martyn Parker, Fort Smith, AR (US)

(73) Assignee: PRUITT TOOL & SUPPLY CO., Fort Smith, AR (US)

( * ) Notice: Subject to any disclaimer, the term of this patent is extended or adjusted under 35 U.S.C. 154(b) by 0 days.

(21) Appl. No.: 17/878,567

(22) Filed: Aug. 1, 2022

Related U.S. Application Data

(63) Continuation of application No. 17/215,299, filed on Mar. 29, 2021, now Pat. No. 11,401,760, which is a continuation of application No. 16/031,975, filed on Jul. 10, 2018, now Pat. No. 10,961,793, which is a continuation-in-part of application No. 15/074,898, filed on Mar. 18, 2016, now Pat. No. 10,018,002.

(60) Provisional application No. 62/135,088, filed on Mar. 18, 2015.

(51) Int. Cl.
*E21B 21/08* (2006.01)
*E21B 21/10* (2006.01)

(52) U.S. Cl.
CPC ..... *E21B 21/08* (2013.01); *E21B 21/106* (2013.01)

(58) Field of Classification Search
CPC ..... E21B 21/16; E21B 21/14; E21B 21/08; E21B 21/06
See application file for complete search history.

(56) References Cited

U.S. PATENT DOCUMENTS 3,104,707 A * 9/1963 Overly ..... E21B 31/03 166/301
3,365,009 A * 1/1968 Burnham ..... E21B 21/08 175/218
3,774,701 A * 11/1973 Weaver ..... E21B 7/00 405/130
4,136,747 A * 1/1979 Mallory ..... E21B 21/14 175/69
5,010,966 A * 4/1991 Stokley ..... E21B 41/005 175/207
6,035,952 A * 3/2000 Bradfield ..... E21B 44/00 175/207
6,413,297 B1 * 7/2002 Morgan ..... B01D 19/0031 96/174

(Continued)

*Primary Examiner* — Shane Bomar
(74) *Attorney, Agent, or Firm* — Schrantz Law Firm, PLLC; Stephen D. Schrantz

(57) ABSTRACT

This system maintains bottom hole pressure and constant well bore pressure profile for a period of time in event of loss of power to rig pumps, rig pump failure or other loss of pressure to the primary flowline. The back pressure system diverts mud into the primary flowline to maintain pressure. The system provides time to get the diesel powered cement unit on line to maintain pressure or get the power reinstated to the rig pumps. The mud discharged into the primary flowline can be recovered back into the housing via the housing inlet line and the housing can be recharged via the N2 high pressure bottle rack. The back pressure system installs upstream of the MPD chokes with interfaces to the primary flow line to divert the drilling mud to the primary flowline.

20 Claims, 3 Drawing Sheets

(56) References Cited

U.S. PATENT DOCUMENTS

| | | | | |
|---|---|---|---|---|
| 8,347,983 | B2 * | 1/2013 | Hoyer | E21B 36/001 175/48 |
| 2008/0060846 | A1 * | 3/2008 | Belcher | E21B 47/06 175/25 |
| 2012/0247831 | A1 * | 10/2012 | Kaasa | E21B 21/08 175/48 |
| 2013/0090855 | A1 * | 4/2013 | Rasmus | E21B 34/06 702/9 |
| 2016/0357888 | A1 * | 12/2016 | Li | E21B 7/00 |
| 2018/0320464 | A1 * | 11/2018 | Heitmann | E21B 31/035 |

* cited by examiner

METHOD AND SYSTEM FOR MAINTAINING CONSTANT BACK PRESSURE DURING MANAGED PRESSURE DRILLING

CROSS-REFERENCE TO RELATED APPLICATIONS

This application claims priority to and is a continuation of U.S. patent application Ser. No. 17/215,299 filed on Mar. 29, 2021 entitled Method and System for Maintaining Constant Back Pressure during Managed Pressure Drilling that is a continuation of U.S. patent application Ser. No. 16/031,975 filed on Jul. 10, 2018 entitled Method and System for Maintaining Constant Back Pressure during Managed Pressure Drilling that issued as U.S. Pat. No. 10,961,793 on Mar. 30, 2021 that is a continuation in part of U.S. patent application Ser. No. 15/074,898 filed on Mar. 18, 2016 entitled Method and System for Maintaining Constant Back Pressure during Managed Pressure Drilling that issued as U.S. Pat. No. 10,018,002 on Jul. 10, 2018 which is a continuation in part of U.S. Patent Application No. 62/135,088 filed on Mar. 18, 2015 entitled Method and System for Maintaining Constant Back Pressure during Managed Pressure Drilling.

STATEMENT REGARDING FEDERALLY SPONSORED RESEARCH OR DEVELOPMENT

Not Applicable.

REFERENCE TO A MICROFICHE APPENDIX

Not Applicable.

RESERVATION OF RIGHTS

A portion of the disclosure of this patent document contains material which is subject to intellectual property rights such as but not limited to copyright, trademark, and/or trade dress protection. The owner has no objection to the facsimile reproduction by anyone of the patent document or the patent disclosure as it appears in the Patent and Trademark Office patent files or records but otherwise reserves all rights whatsoever.

BACKGROUND OF THE INVENTION

1. Field of the Invention

The present invention relates to managed pressure drilling (MPD) operations. More specifically, the present invention is related to maintaining constant back pressure on a well bore during managed pressure drilling operations in event of mud pump failure, loss of power, or both mud pump failure and loss of power.

SUMMARY OF THE INVENTION

During managed pressure drilling (MPD) operation, sudden rig mud pump failure or loss of electrical power to power the mud pumps will reduce the equivalent circulating density (ECD). The ECD could be potentially lost altogether.

Fully automated MPD chokes will attempt to close as fast as possible to trap any residual pressure. The MPD chokes alone may not be sufficient to prevent borehole failure or well collapse. When maintaining a constant bottom hole pressure, preventing loss in wellbore strength requires a constant well bore pressure profile. The constant well bore pressure profile prevents unstable formations from collapsing.

The system and method described below and shown in FIG. 1 maintains constant bottom hole pressure and/or constant well bore pressure profile in the event of loss of power to the rig's mud pumps and or auxiliary back pressure pumps.

The system and method maintains bottom hole pressure and/or constant well bore pressure profile for a period of time in the event of loss of power to rig pumps. The period of time of maintaining bottom hole pressure and/or constant well bore pressure profile depends upon the volume of mud available from the pressure vessel.

The object of the present invention is to reduce well loss caused by borehole stability problems. The system and method provides the user with time to activate the diesel powered cement unit to maintain pressure or reinstate power to the rig pumps.

The mud discharged into the primary flowline can be recovered back into the vessel via the vessel inlet line. The vessel can be recharged via the N2 high pressure bottle rack.

The system must be installed upstream of the MPD chokes and/or valves with interfaces to the primary flow line.

It is an object of the present invention to maintain constant back pressure on a well bore during MPD operations in the event of mud pump failure.

It is also an object of the present invention to maintain constant back pressure on a well bore during MPD operations in the event of loss of power.

In addition to the features and advantages of the present invention, further advantages thereof will be apparent from the following description in conjunction with the appended drawings.

These and other objects of the invention will become more fully apparent as the description proceeds in the following specification and the attached drawings. These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION

During MPD operation in the event of sudden rig mud pump failure or loss of electrical power to power the mud pumps, the equivalent circulating density (ECD) will be reduced or lost altogether.

Fully automated MPD chokes and/or valves will attempt to close as fast as possible to trap any residual pressure. This closure alone may not be sufficient to prevent borehole failure and/or well collapse. When maintaining a constant bottom hole pressure, constant well bore pressure profile is required. The constant well bore pressure profile prevents loss in wellbore strength to prevent unstable formations from collapsing.

Figure 1:
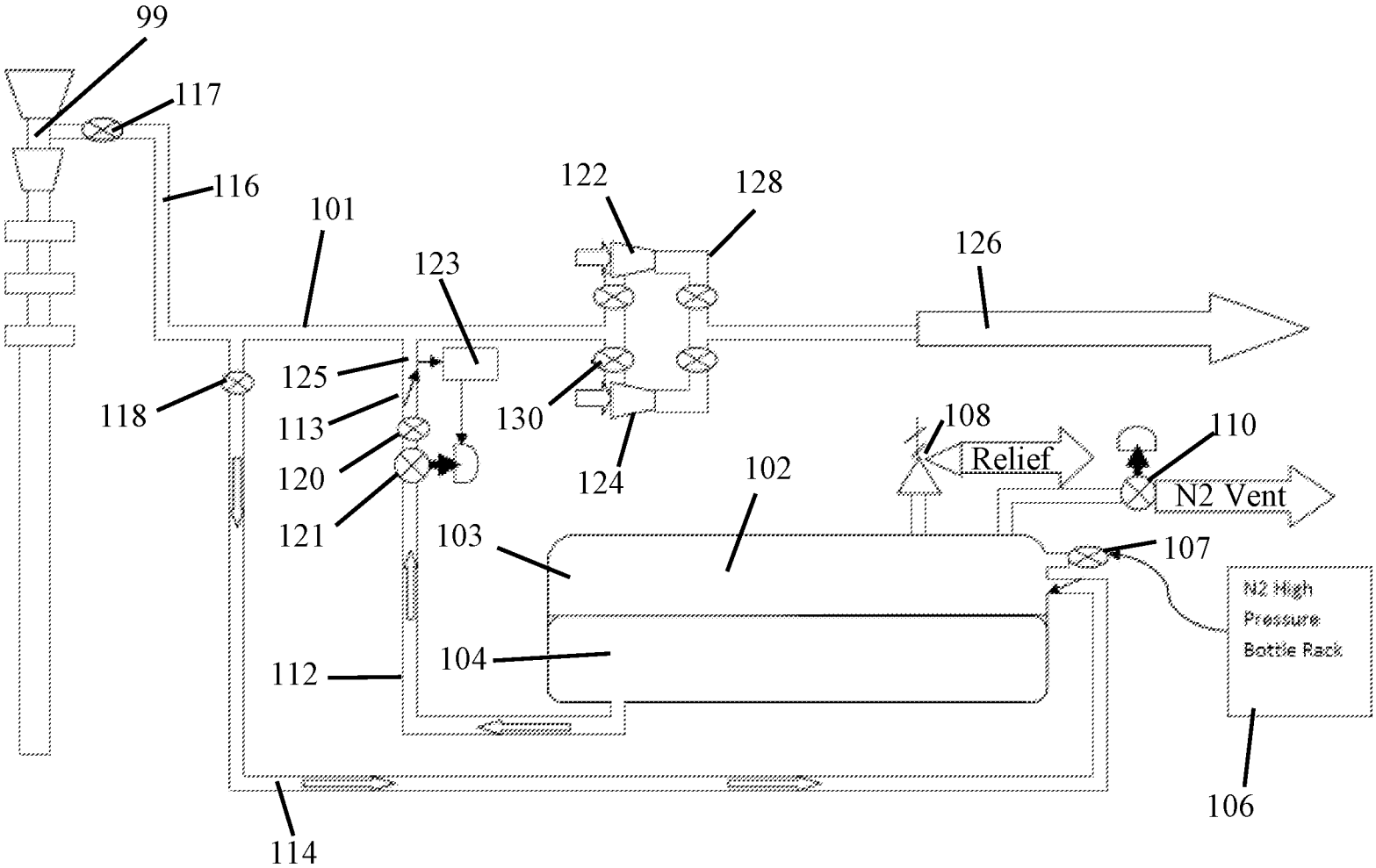
FIG. 1 is a schematic view of one embodiment of the present invention.

FIG. 1 shows one view of the system and equipment designed to maintain constant bottom hole pressure and a constant well bore pressure profile. The process, equipment set-up, and system detailed below maintains constant bottom hole pressure and constant well bore pressure profile in the event of loss of power to the rig's mud pumps and or auxiliary back pressure pumps. The system and method may be implemented in MPD applications.

This system and method maintains bottom hole pressure and constant well bore pressure profile for a period of time in the event of loss of power to rig pumps. If the well is on, the time available will depend on the volume of mud available from the pressure vessel.

The mud discharged into the primary flowline can be recovered back into the vessel via the vessel inlet line and the vessel can be recharged via the N2 high pressure bottle rack as shown in FIG. 1.

The managed pressure drilling operation is shown generally at 100. The operation 100 includes a rotating control device 99 ("RCD") with a primary flowline 116. Fluids flow from the RCD 99 through valve 117 into primary flowline 116. Valve 117 remains open during normal operation. The back pressure system generally shown as 101 is installed onto the primary flowline 116. The back pressure system 101 installs upstream of the MPD pressure control 128 with chokes 122, 124. Fluid passes through the MPD pressure control 128 to the meter and rig mud returns 126.

The MPD pressure control 128 provides four valves. In one embodiment, one of the valves 130 upstream of the chokes 122, 124 is normally closed during normal operation. The other valves of MPD pressure control 128 are normally open.

The back pressure system 101 must be installed upstream of the MPD pressure control 128 with interfaces to the primary flowline 116. The back pressure system 101 provides a housing 102, such as a pressurized housing, for storing mud 104. A pressurized system attaches to housing 102 to increase the pressure within the housing 102. A compressed gas system 106, such as a nitrogen ($N_2$) high pressure bottle rack, attaches to housing 102 to serve as the pressurized system. The compressed gas system 106 increases the pressure of the housing 102 to direct the mud 104 through housing outlet line 112 into primary flowline 116. Prior to MPD operation, drilling mud 104 and a nitrogen charge in charged space 103 is applied to housing 102.

To maintain the integrity of the housing 102, the back pressure system 101 provides both relief valve 108 and vent valve 110. The relief valve 108 releases the gas from the housing 102 to prevent too great of pressure existing within housing 102. The vent valve 110 releases the gas from the housing 102 to control the pressure of housing 102. The vent valve 110 may be controlled by a vent pressure controller to open and close vent valve 110 to achieve the appropriate pressure within housing 102. The vent valve 110 opens to release the gas through the vent to reduce pressure of charged space 103. The valve closes to maintain the gas within housing 102 to increase the pressure of charged space 103 for delivery of mud 104 to primary flowline 116.

The system 101 provides a housing inlet line 114 and a housing outlet line 112 that allow mud 104 into and out of the housing 102. Housing inlet line 114 enables the flow from the primary flowline to the housing 102. Housing outlet line 112 enables the flow of mud 104 from housing 102 back into the primary flowline 116. The flow of mud 104 returning to the primary flowline 116 increases the back pressure to maintain bottom hole pressure.

Inlet valve 118 allows fluid to flow from primary flowline 116 through inlet valve 118. Inlet valve 118 opens to allow the fluid to flow into housing inlet line 114. The inlet valve 118 opens to fill the housing inlet line 114. Inlet valve 118 closes after the housing inlet line 114 fills. Valve 118 remains closed during normal operation. The fluid pumped into housing inlet line 114 flows to housing 102. Check valve 115 prevents the fluid from flowing from housing 102 into housing inlet line 114.

Housing 102 provides the mud 104 and other fluids needed to maintain constant back pressure. Charged space 103 provides a volume of the compressed gas needed to divert drilling mud 104 through the housing outlet line 112 to the primary flowline 116. Compressed gas 106, such as the high pressure bottle rack, charges the charged space 103 with a compressed gas, such as nitrogen. Valve 107 remains open during normal operation to keep charged space 103 charged with the gas. Maintaining charged space 103 allows for quick delivery of mud 104 to the primary flowline 116.

The pressure controller instructs the valve 110 to open to vent some of the compressed gas, such as nitrogen, to reduce the pressure of charged space 103. Likewise, pressure controller may instruct valve 110 to close to increase the pressure of charged space 103 with additional nitrogen.

The back pressure system 101 directs mud 104 into the primary flowline to maintain constant back pressure. The back pressure system 101 activates in events of loss of rig electrical power, failure of rig pump, sudden failure of rig pump, and loss in pressure of primary flowline 116. Pressure control 123 includes a sensor that detects pressure in the primary flowline. The sensor 125 of pressure control 123 detects the pressure of the primary flowline 116 above the check valve 113. Check valve 113 prevents fluid flowing from primary flowline 117 further through housing outlet line 112. If pressure control 123 detects a pressure drop in primary flowline 116, back pressure system 101 activates to stabilize the back pressure.

The sensor 125 is located upstream of check valve 113 and valves 120, 121. Valve 120 remains open during normal operation of the drilling rig. Outlet control valve 121 is operated by pressure control 123. Depending upon the pressure of primary flowline 116 detected by sensor 125, pressure control 123 opens or closes valve 121. Pressure control 123 opens outlet control valve 121 if sensor 125 detects loss in pressure of primary flowline 116. Otherwise, pressure control 123 closes valve 121.

If loss of pressure is detected by pressure control 123, MPD chokes 122, 124 of MPD pressure control 128 will close if possible to trap pressure within primary flowline 116. The MPD pressure control 128 attempts to hold the required pressure for a static well condition.

Pressure control 123 also opens valve 121 to divert mud 104 into primary flowline 116 to increase the pressure. Pressure control 107 may also release additional compressed gas 106 to divert additional mud 104 into the primary flowline 116. Valves 120, 121 are open to allow the mud 104 to flow to the primary flowline 116. Drilling mud 104 flows from housing 102 through housing outlet line 112. Back pressure system diverts mud 104 through valves 121, 120, 113 to primary flowline 116.

The mud 104 maintains the back pressure for a temporary period of time. The rig personnel must attempt to repair the rig to restore the proper pressure. These repairs may include but are not limited to restoring power to the rig, repairing a rig pump, replacing a rig pump, and other restoring pressure.

Figure 2:
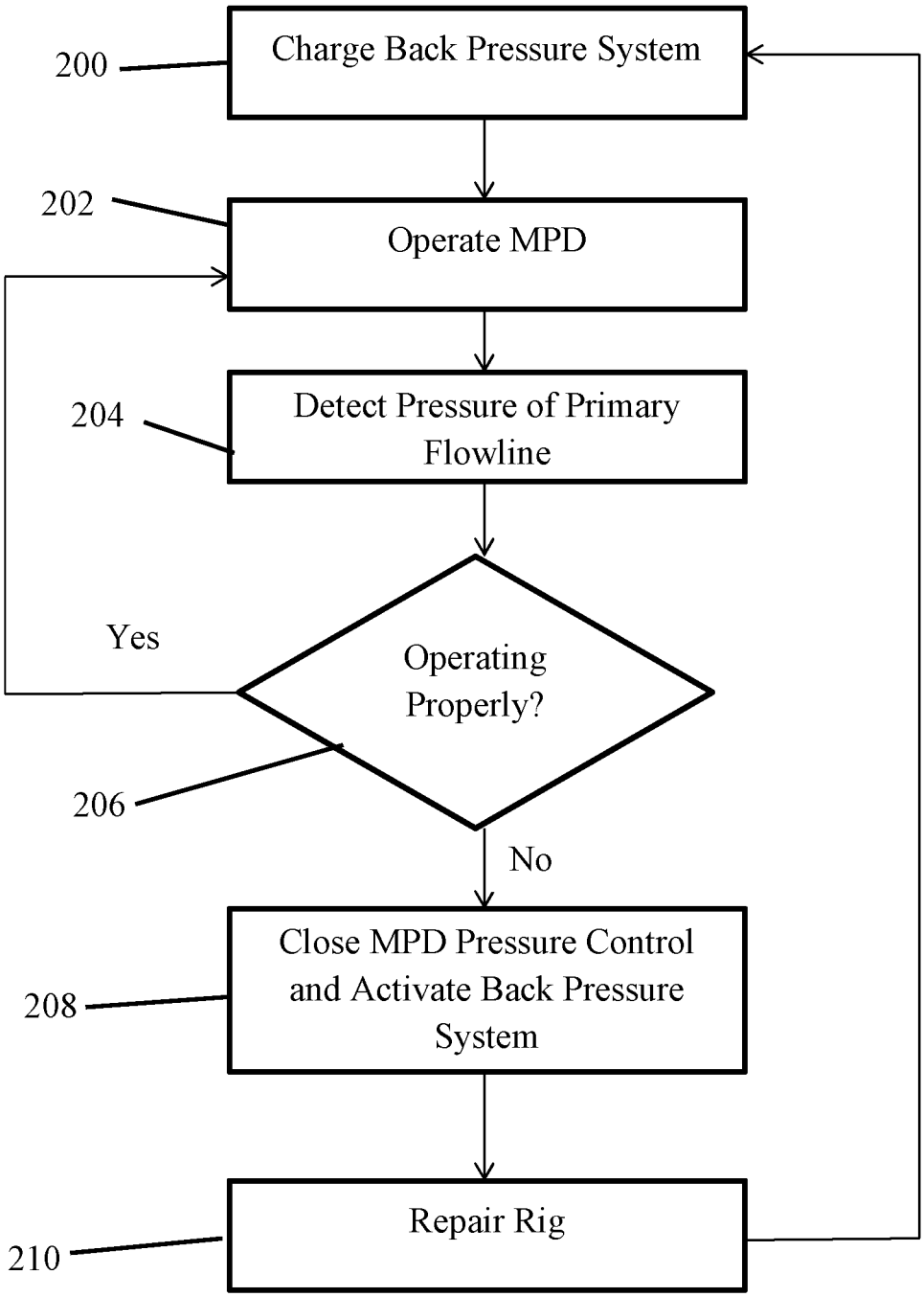
FIG. 2 is a flow chart of one embodiment of the present invention.
Figure 3:
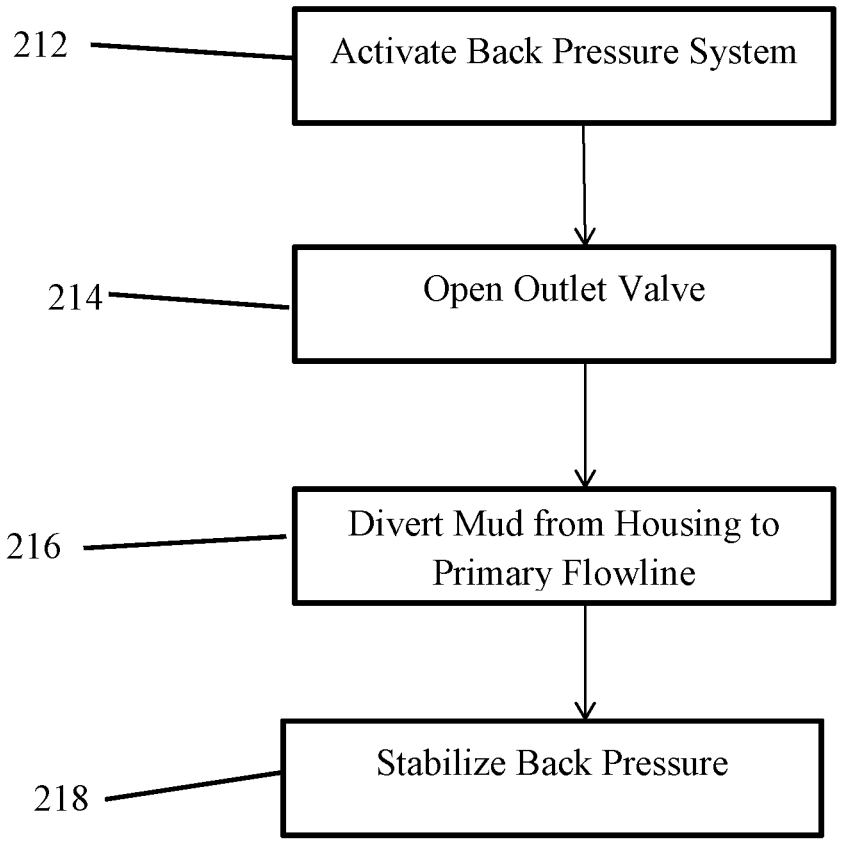
FIG. 3 is a flow chart thereof.

FIGS. 2 and 3 show a flow chart of one embodiment of the present invention. At charge step 200, the system charges back pressure system 101. The charging step includes storing mud 104 within housing 102. The charging step also includes pressurizing the housing 102 with a compressed gas, such as nitrogen, to housing 102. The compressed gas includes nitrogen as nitrogen is an inert gas. Other inert gases may be used.

After the system 101 and housing 102 are properly charged, the user may operate the MPD at Operate MPD step 202. The system checks to determine if the MPD operation is operating properly at Operating Properly query 206. Sensors, such as sensor 125, detect the pressure of the primary flowline 116. The drilling operation continues as long as the sensor does not detect a loss of pressure at Operating Properly query 206. At Operating Properly query 206, the system also confirms that the rig electrical power is operating properly. The system also confirms that the rig pumps for the circulating system are operating properly. If the system detects that the rig electrical power and rig pumps are operating properly and the sensor 125 does not detect a sufficient loss of pressure in the primary flowline, the system continues to operate at Operate MPD. The system does not activate the back pressure system 101.

If the system detects a loss of rig electrical power, a failure of a rig pump, such as a sudden failure, or sensor 125 detects a sufficient loss in pressure in the primary flowline at Operating Properly query 206, the system activates the back pressure system 101 at Close MPD step 208. The system closes the chokes, etc. of the MPD pressure control system 128 to trap pressure to hold the required pressure for a static well condition.

Pressure control 123 opens valve 121 to divert mud 104 to primary flowline 116 to compensate for no circulation. The mud increases the back pressure to limit loss of back pressure. However, the housing 102 is of a limited size to which only a set amount of mud and pressure can be applied. Because the back pressure system 101 is a temporary solution, rig personnel must troubleshoot the problem to repair the rig at Repair Rig step 210. Such repairs may include but are not limited to restoring electrical power to the rig, repairing or replacing a rig pump, and restoring pressure to the primary flowline 116. If the well suffers from losses from the wellbore, the rig pumps or a secondary pump should be started as soon as possible.

From the foregoing, it will be seen that the present invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A system for maintaining back pressure in a managed pressure drilling operation by diverting drilling fluid to a primary flowline of fluid flowing from a rotating control device, the system comprising:

a housing for storing the drilling fluid;

a compressed gas container storing a gas, wherein the gas container connects to the housing, wherein the gas from the gas container flows into the housing;

a housing outlet line from the housing towards the rotating control device, wherein the drilling fluid flows from the housing through the housing outlet line towards the rotating control device; and the gas flowing from the gas container to the housing to direct the drilling fluid towards the rotating control device.

2. The system of claim 1 further comprising:

a pressure control valve located on the housing outlet line, the pressure control valve closing to limit the drilling fluid flowing from the housing to the rotating control device.

3. The system of claim 2 further comprising:

a pressure control in communication with the pressure control valve, the pressure control opening the pressure control valve to divert the drilling fluid to the rotating control device.

4. The system of claim 3 wherein the pressure control opens the pressure control valve upon detecting a loss of pressure in the primary flow line.

5. The system of claim 4 further comprising:

a sensor located at the primary flowline, the sensor detecting the pressure of the primary flowline for the pressure control.

6. The system of claim 3 further comprising:

a housing inlet line running from the primary flowline to the housing, the housing inlet line enabling fluid to flow from the primary flowline to the housing.

7. The system of claim 6 further comprising:

an inlet valve that closes to limit the fluid flowing from the primary flowline to the housing inlet line, the inlet valve closing after a sufficient amount of fluid is diverted to the housing.

8. The system of claim 7 wherein the inlet valve closes during the managed pressure drilling operation.

9. The system of claim 3 further comprising:

a relief valve of the housing to relieve pressure from the housing.

10. The system of claim 3 further comprising:

a vent valve of the housing controlled by a vent pressure control, the vent pressure control opening and closing the vent valve to control pressure within the housing.

11. A system for maintaining back pressure in a managed pressure drilling operation by diverting drilling fluid to a primary flowline of fluid flowing from a rotating control device, the system comprising:

a housing for storing the drilling fluid;

a gas container storing nitrogen, where the gas container connects to the housing to add nitrogen to the housing, wherein the nitrogen flows into the housing to direct the drilling fluid towards the rotating control device;

a housing outlet line from the housing towards the rotating control device, wherein the drilling fluid flows from the housing through the housing outlet line towards the rotating control device;

a pressure control valve located on the housing outlet line, the pressure control valve closing to limit the drilling fluid flowing from the housing to the rotating control device.

12. The system of claim 11 further comprising:

a housing inlet line running from the primary flowline to the housing, the housing inlet line enabling fluid to flow from the primary flowline to the housing.

13. The system of claim 12 further comprising:

a pressure control in communication with the pressure control valve, the pressure control opening the pressure control valve to divert the drilling fluid to the rotating control device.

14. The system of claim 13 wherein the pressure control opens the pressure control valve upon detecting a loss of pressure in the primary flow line.

15. The system of claim 13 wherein the pressure control opens the pressure control valve upon detecting a loss of rig electrical power.

16. The system of claim 13 wherein the pressure control opens the pressure control valve upon detecting a failure of a rig pump.

17. The system of claim 13 further comprising:

an inlet valve that closes to limit the fluid flowing from the primary flowline to the housing inlet line, the valve closing after a sufficient amount of fluid is diverted to the housing.

18. A method for maintaining back pressure in a managed pressure drilling operation by diverting drilling fluid to a primary flowline of fluid flowing from a rotating control device, the method comprising:

storing the drilling fluid in a housing, wherein the housing is connected to the primary flow line;

supplying gas to the housing to increase the pressure within the housing;

wherein supplying the gas to the housing directs the drilling fluid from the housing to the rotating control device.

19. The method of claim 18 further comprising:

opening a pressure control valve to direct the drilling fluid to the rotating control device wherein closing the pressure control valve limits drilling fluid flowing from the housing to the rotating control device.

20. The method of claim 19 further comprising:

detecting a loss of pressure in the primary flowline with a sensor in the primary flowline prior to opening the pressure control valve.

* * * * *